US007177573B2

(12) United States Patent
Kimura et al.

(10) Patent No.: US 7,177,573 B2
(45) Date of Patent: Feb. 13, 2007

(54) IMAGE FORMING APPARATUS WITH REVERSELY ROTATED DEVELOPER BEARING MEMBERS

(75) Inventors: Noriyuki Kimura, Kawasaki (JP); Nobuhiko Umezawa, Yokohama (JP); Takeroh Kurenuma, Yokosuka (JP); Hideyuki Takemoto, Kawasaki (JP)

(73) Assignee: Ricoh Company Limited, Tokyo (JP)

( * ) Notice: Subject to any disclaimer, the term of this patent is extended or adjusted under 35 U.S.C. 154(b) by 193 days.

(21) Appl. No.: 10/849,821

(22) Filed: May 21, 2004

(65) Prior Publication Data

US 2004/0234296 A1 Nov. 25, 2004

(30) Foreign Application Priority Data

May 23, 2003 (JP) ..... 2003-146881

(51) Int. Cl.
*G03G 15/06* (2006.01)

(52) U.S. Cl. ..... 399/222; 399/228

(58) Field of Classification Search ..... 399/222, 399/223, 228

See application file for complete search history.

(56) References Cited

U.S. PATENT DOCUMENTS

| | | | |
|---|---|---|---|
| 4,922,301 | A | 5/1990 | Katoh et al. |
| 5,168,319 | A | 12/1992 | Kimura et al. |
| 5,198,866 | A | 3/1993 | Kimura et al. |
| 5,258,819 | A | 11/1993 | Kimura et al. |
| 5,325,151 | A | 6/1994 | Kimura et al. |
| 5,331,390 | A | 7/1994 | Kimura et al. |
| 5,465,139 | A | 11/1995 | Kimura et al. |
| 5,512,984 | A | 4/1996 | Kimura et al. |
| 5,537,197 | A | 7/1996 | Fujishiro et al. |
| 5,565,973 | A | 10/1996 | Fujishiro et al. |
| 5,583,630 | A | 12/1996 | Kimura et al. |
| 5,655,193 | A | 8/1997 | Fujishiro et al. |
| 5,671,465 | A | 9/1997 | Kimura et al. |
| 5,797,069 | A | 8/1998 | Kimura et al. |
| 5,953,568 | A | 9/1999 | Fujishiro et al. |
| 6,122,470 | A | 9/2000 | Kimura |
| 6,192,211 | B1 | 2/2001 | Kimura |

(Continued)

FOREIGN PATENT DOCUMENTS

| | | |
|---|---|---|
| JP | 5-113714 | 5/1993 |

(Continued)

*Primary Examiner*—David M. Gray
*Assistant Examiner*—Ryan Gleitz
(74) *Attorney, Agent, or Firm*—Oblon, Spivak, McClelland, Maier & Neustadt, P.C.

(57) ABSTRACT

An image forming apparatus including an image bearing member bearing latent images; a developing unit including plural developing devices developing the latent images with developers to form visual images, each developing device including a developer bearing member bearing the developer to develop the latent image, and a developer thickness controlling member contacting the developer bearing member to control the thickness of a developer layer on the developer bearing member; and a driving device including at least one driving source, a forward rotation driving member rotated by the driving source to drive the developer bearing members to forwardly rotate to develop the latent images, and a reverse rotation driving member rotated by the driving source to drive the developer bearing members to reversely rotate when the developing operation is not performed, wherein the forward rotation driving member and the reverse rotation driving member can operate at the same time.

5 Claims, 12 Drawing Sheets

U.S. PATENT DOCUMENTS 6,330,405 B1 * 12/2001 Ishii et al. ..... 399/55
6,643,486 B1 11/2003 Endoh et al.
6,775,506 B2 8/2004 Endoh et al.
6,832,063 B2 * 12/2004 Ahn et al. ..... 399/223

FOREIGN PATENT DOCUMENTS

JP 2000284597 A * 10/2000
JP 2001-83801 3/2001
JP 2001-356589 12/2001
JP 2002-182470 6/2002
JP 2002189345 A * 7/2002
JP 2002268380 A * 9/2002

* cited by examiner

IMAGE FORMING APPARATUS WITH REVERSELY ROTATED DEVELOPER BEARING MEMBERS

BACKGROUND OF THE INVENTION

1. Field of the Invention

The present invention relates to an image forming apparatus such as copiers, facsimiles and printers. More particularly, the present invention relates to a driving device for rotating a developer bearing member which is arranged so as to face an image bearing member to develop an electrostatic latent image on the image bearing member with a developer.

2. Discussion of the Background

Published Unexamined Japanese Patent Applications Nos. (hereinafter referred to as JP-As) 2001-083801 and 2002-182470 have disclosed image forming apparatus including a photoreceptor serving as an image bearing member and a plurality of developing devices which contain respective developers (different color toners) and develop electrostatic latent images with the different color toners to form multi-color images.

Developing devices using a one component developing method are typically used for such image forming apparatus. The one-component developing methods are as follows:

(1) a one component developer which is constituted by toner particles optionally including an external additive and which does not include a carrier is supplied to a developer bearing member (such as developing roller); and (2) a toner layer having a predetermined thickness is formed on the surface of the developer bearing member using a developer thickness controlling member to develop an electrostatic latent image on an image bearing member with the toner layer, resulting in formation of a toner image on the image bearing member.

The one component developing method has the following advantages over two component developing methods which use a two component developer including a toner and a carrier:

(1) it is not necessary to control the toner concentration in the developer; and (2) it is not necessary to provide an agitator configured to mix and agitate the toner and the carrier, and thereby the developing device can be simplified (i.e., the developing device can be miniaturized).

However, the developing devices using a one component developing method have the following drawbacks:

(1) toner particles sandwiched by the developing roller which rotates and the developer thickness controlling member are melted due to frictional heat, and thereby the toner particles tend to aggregate; and (2) foreign materials invade the nip between the developing roller and the developer thickness controlling member, thereby causing a problem in that a portion of an image has low image density or the resultant image has a white streak due to uneven thickness of the toner layer and/or another problem in that the developing roller and the developer thickness controlling member are damaged by the foreign materials.

JP-As 2002-182470, 2001-356589 and 05-113714 have disclosed techniques in that the developing roller is reversely rotated to remove the foreign materials staying at the nip between the developing roller and the developer thickness controlling member from the nip to prevent occurrence of the above-mentioned problems.

FIG. 1 is a schematic view illustrating a background driving device for use in an image forming apparatus having a contact/separate mechanism similar to that described in JP-A 2001-083801. The background driving device includes a driving motor 31 which is provided on a housing of the main body of the image forming apparatus and has a motor gear 31A; and two first gears, i.e., an upper first gear 32A and a lower first gear 32A' both of which are engaged with the motor gear 31A. An upper second gear 32B and a lower second gear 32B' are engaged with the upper first gear 32A and the lower first gear 32A', respectively.

The upper second gear 32B is engaged with a third gear 32C(K) which is fixedly mounted on a clutch 32D(K) and which is used for driving a black color (K) developing device. In addition, the upper second gear 32B is also engaged with a third gear 32C(Y) which is fixedly mounted on a clutch 32D(Y) and which is used for driving a yellow color (Y) developing device.

The lower second gear 32B' is engaged with a third gear 32C(C) which is fixedly mounted on a clutch 32D(C) and which is used for driving a cyan color (C) developing device. In addition, the lower second gear 32B' is also engaged with a third gear 32C(M) which is fixedly mounted on a clutch 32D(M) and which is used for driving a magenta color (M) developing device. These third gears 32C are arranged in a line in the vertical direction.

The clutch 32D(K) and a driving gear 34(K), which drives a black color (K) developing cartridge (not shown) and a black color (K) developing roller (not shown) to rotate, are coaxially mounted on a driving shaft 33(K). When the clutch 32D(K) is not engaged, the third gear 32C(K) idles. When the clutch 32D(K) is engaged, the third gear 32C(K) is connected with the driving shaft 33(K), and thereby the driving shaft 33(K) is rotated.

As mentioned above, the driving gear 34(K) is fixedly mounted on the driving shaft 33(K). A driven gear 35(K) which is illustrated by a dotted line in FIG. 1 is engaged with an upper portion of the driving gear 34(K). The driven gear 35(K) is fixedly mounted on a rotating shaft 38(K) of the black color developing roller (not shown in FIG. 1).

When the clutch 32D(K) is engaged, the driving force of the third gear 32C(K) is transmitted to the driving shaft 33(K). Thereby the driving gear 34(K) is rotated, and the driving force is transmitted to the driven gear 35(K), resulting in rotation of the black color developing roller. At the same time, the black color developing cartridge is moved toward an image bearing member (i.e., a photoreceptor) due to the tangential force caused by engagement between the driving gear 34(K) and the driven gear 35(K).

Similarly to the above-mentioned driving operations of the black color developing roller and the black color developing cartridge, the developing rollers and developing cartridges for use in cyan (C) color, magenta (M) color and yellow (Y) color development operations are driven.

FIG. 10(A) is a schematic view illustrating the developing operation of a background image forming apparatus having the above-mentioned background driving device. As illustrated in FIG. 10(A), the driving motor 31 is forwardly rotated at a predetermined rotational speed while the clutches K, M, Y and C are sequentially engaged for a predetermined time to perform four color development operations. After the four color development operations, the driving motor 31 is stopped, followed by reverse rotation of the driving motor 31 at a rotational speed the same as or lower than that for the forward rotation. In this case, the clutches K, M, Y and C are sequentially engaged to remove foreign materials staying at the nip between the four color developing rollers and the developer thickness controlling members.

However, when image forming operations are continuously performed several times, the foreign material removing operation (i.e., the reverse rotation operation of the developing roller) has to be performed at the end of each image forming operation, and thereby the image forming speed is decreased.

In attempting to solve the problem, JP-A 05-113714 discloses a technique in that the foreign material removing operation is performed after performing the image forming operations predetermined times. However, the problems in that the image qualities deteriorate and/or the resultant images have white streaks often occur during a time period between a foreign material removing operation and the next foreign material removing operation.

Because of these reasons, a need exists for a developing device which can form visual images at a high speed without causing image quality deterioration problems such as formation of the white streak images.

SUMMARY OF THE INVENTION

Accordingly, an object of the present invention is to provide an image forming apparatus which can produce visual images having good image qualities at a high speed.

Briefly this object and other objects of the present invention as hereinafter will become more readily apparent can be attained by an image forming apparatus including:

an image bearing member configured to bear latent images;

a developing unit including:

a plurality of developing devices configured to develop the latent images with respective developers to form visual images on the image bearing member, wherein each of the plurality of developing devices includes:

a developer bearing member configured to bear the corresponding developer to develop the corresponding latent image; and a developer thickness controlling member which contacts the corresponding developer bearing member to control the thickness of a layer of the corresponding developer on the corresponding developer bearing member, and a driving device including:

at least one driving source;

a forward rotation driving member which is rotated by the at least one driving source to drive the developer bearing members to rotate in a first direction to develop the latent images; and a reverse rotation driving member which is rotated by the at least one driving source to drive the developer bearing members to rotate in a second direction opposite to the first direction when the developer bearing members do not perform the developing operation, wherein the forward rotation driving member and the reverse rotation driving member can operate at the same time.

It is preferable that the developer thickness controlling member has a roller-form, wherein the developer thickness controlling members are stopped when the respective developer bearing members rotate to develop the latent images, and when the respective developer bearing members are reversely rotated, the developer thickness controlling members is rotated while driven by the respective developer bearing members.

In addition, it is preferable that the driving device further includes:

driving gears mounted on both ends of respective support shafts of the developer bearing members, wherein the developer bearing members are supported by the respective support shafts; and drive force transmitting gears which are engaged with the respective driving gears, wherein when the driving gears are rotated to rotate the respective developer bearing members, the corresponding developing device is moved a position close to the image bearing member due to the tangential driving force of the driving gears.

In this image forming apparatus, the forward driving member rotates one of the developer bearing members in the developing operation and the reverse rotation driving member reversely rotates different one of the developer bearing members when the developing operation is not performed can be driven at the same time. Namely, it is possible that when one of the developer bearing members is rotated in a direction to perform the developing operation, different one of the developer bearing members is rotated in the reverse direction to remove foreign materials and aggregated toner particles staying at the nip.

Thus, foreign materials and aggregated toner particles staying at the nip can be removed (i.e., deterioration of image qualities can be prevented) without reducing the image forming speed (i.e., the image developing speed).

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The image forming apparatus of the present invention will be explained referring to a color laser printer (hereinafter referred to as a printer) having four sets of developing devices.

Figure 2:
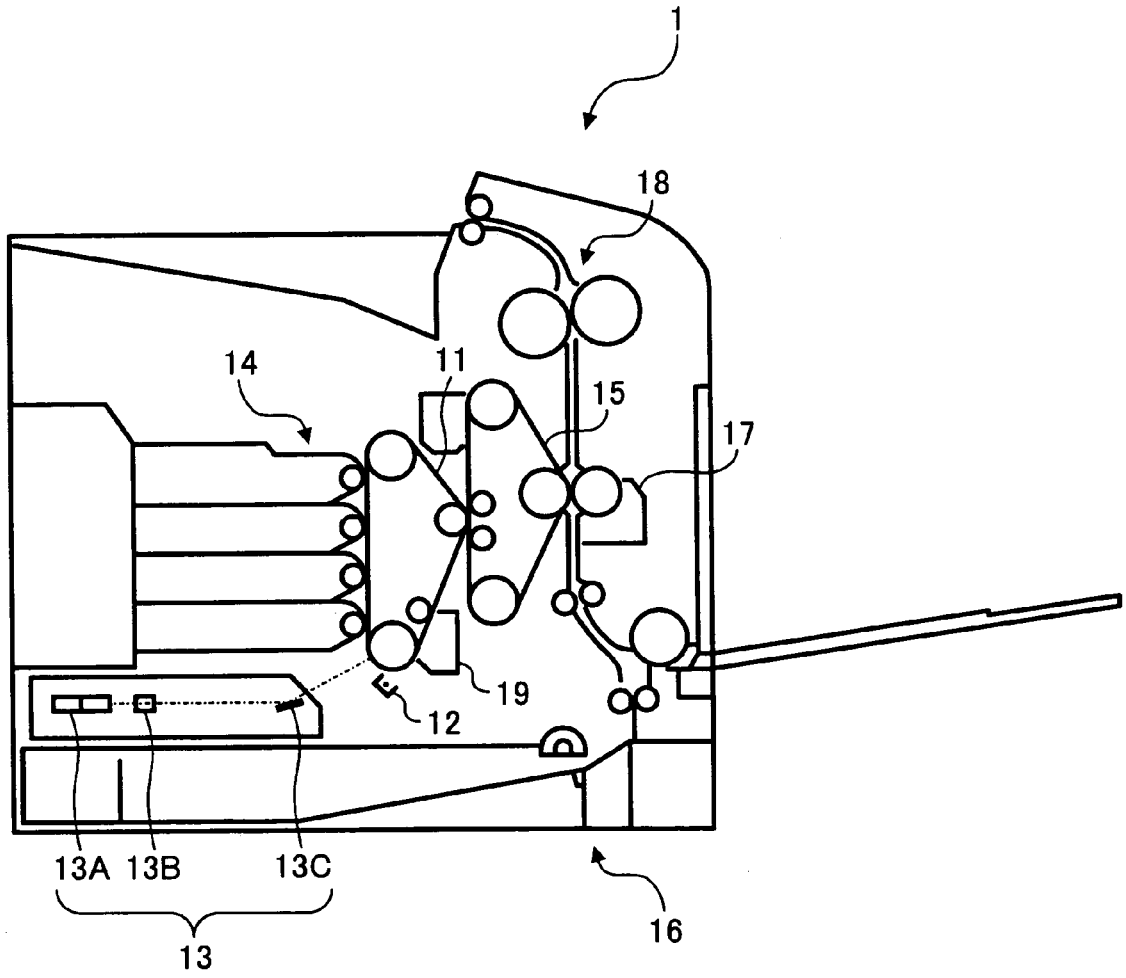
FIG. 2 is a schematic view illustrating the main portion of an embodiment of the image forming apparatus of the present invention.

FIG. 2 is a schematic front view of the printer. A printer 1 includes a photoreceptor 11 serving as an image bearing member, a charger 12, a writing device 13, a developing unit 14 having four sets of developing devices, an intermediate transfer medium 15, a paper feeding device 16, a transfer device 17, a fixer 18, a cleaner 19, etc.

In this embodiment, the photoreceptor 11 is a belt photoreceptor on the surface of which an organic photosensitive layer is formed. Around the photoreceptor 11, the charger 12, the developing unit 14 and the cleaner 19 are arranged.

The charger 12 applies a high voltage to the photoreceptor 11 to uniformly charge the photoreceptor 11.

The writing device 13 includes a laser diode (not shown), a polygon mirror 13A, an f/θ lens 13B, a reflection mirror 13C, etc. Laser light is emitted from the laser diode according to the image signals corresponding to a black color (K) image, a cyan color (C) image, a magenta color (M) image and a yellow color (Y) image. The thus emitted laser light is reflected from the polygon mirror 13A and passes through the f/θ lens 13B, followed by reflection from the reflection mirror 13C to irradiate the surface of the photoreceptor 11. Thus, an electrostatic latent image is formed on the photoreceptor 11.

Figure 3:
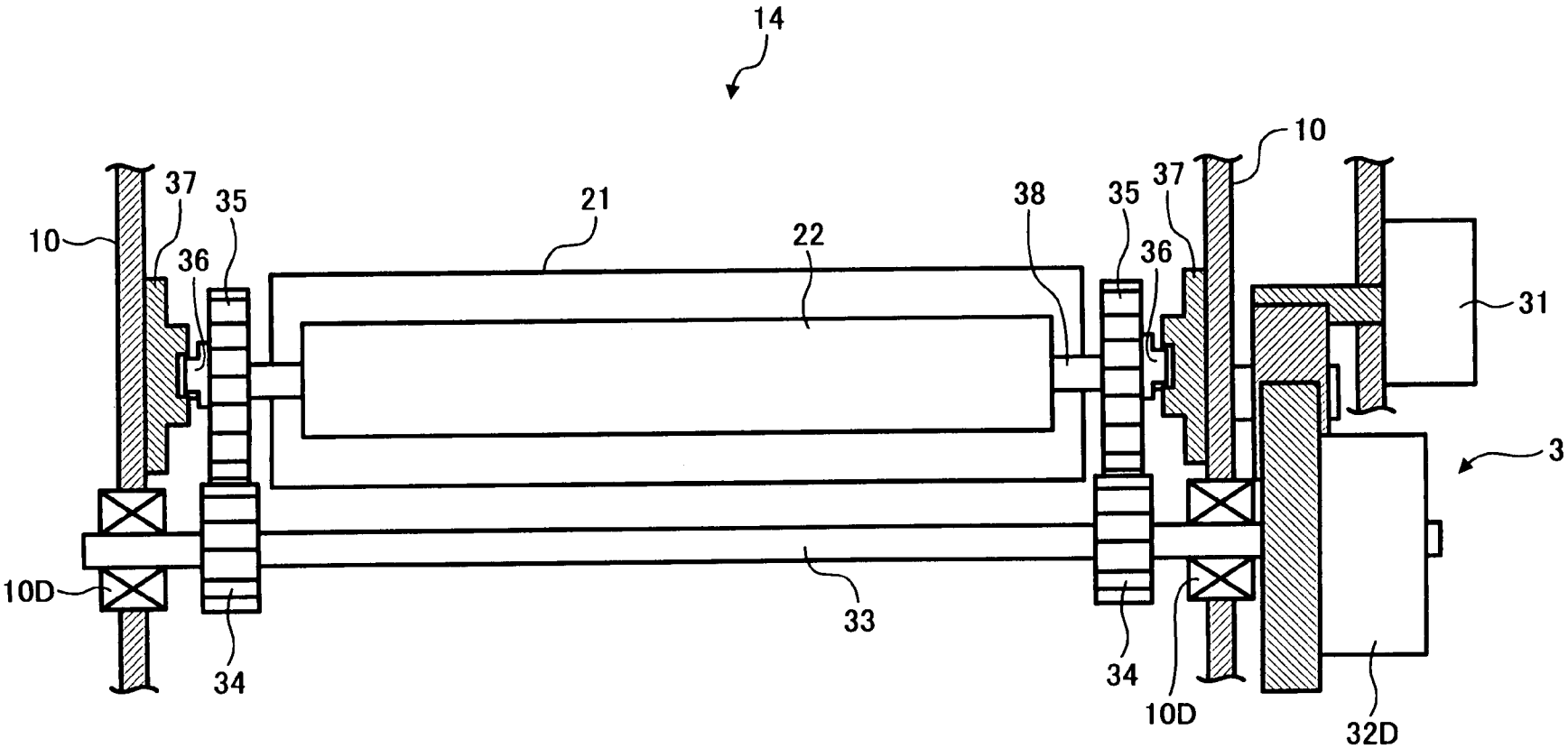
FIG. 3 is a schematic view illustrating a contact/separate mechanism for use in the developing device of the image forming apparatus of the present invention.

The developing unit 14 includes four developing cartridges which contain different color toners having a charge opposite to that of the charge formed on the photoreceptor 11 but have the same constitution. Only one developing cartridge 21 is illustrated in FIG. 3 as one embodiment of the developing cartridge.

Figure 4:
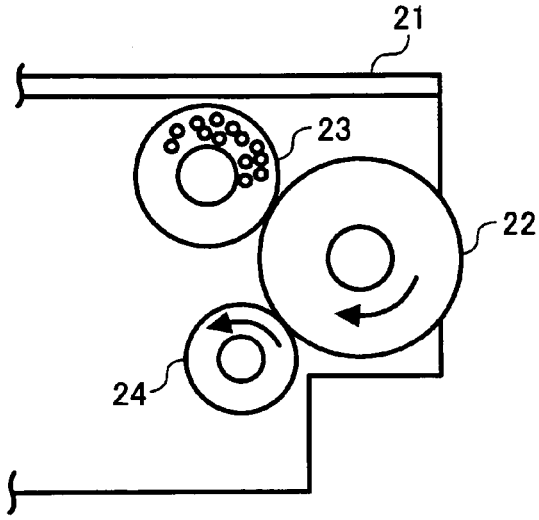
FIG. 4 is a view for explaining how the developing roller and the developer thickness controlling member are rotated in the non-developing state.

As illustrated in FIG. 4, the developing cartridge 21 includes a developing roller 22, a toner supplying roller 23 configured to supply the toner to the developing roller 22, and a regulation roller 24 (i.e., a developer thickness controlling member) configured to control the thickness of the toner layer formed on the developing roller 22 while contacting the developing roller 22. In this case, the developer thickness controlling member is a roller. However, the member is not limited thereto and may be a blade, or the like members.

Referring to FIG. 2, the intermediate transfer medium 15 is contacted with a portion of the photoreceptor 11. A voltage having a polarity opposite to that of the charges of the toners is applied to the intermediate transfer medium 15. Therefore, the toner images formed on the photoreceptor 11 are transferred onto the intermediate transfer medium 15 one by one. Thus, a color toner image constituted of four color toner images is formed on the intermediate transfer medium 15.

The thus prepared color toner image is transferred onto a receiving paper, which has been fed by the paper feeding device 16, by the transfer device 17 while a voltage having a polarity opposite to that of the charges of the toners is applied to the receiving paper. The color image transferred on the receiving paper is melted and fixed on the receiving paper by the fixer 18. The thus prepared color copy is discharged from the printer 1.

Referring to FIG. 3, the developing device of the developing unit 14 includes a contact/separate mechanism 3 configured to approach (or contact) the developing cartridge 21 to and separate the cartridge from the photoreceptor 11. The contact/separate mechanism 3 is provided for each of the K, Y, C and M developing cartridges 21.

Figure 5A:
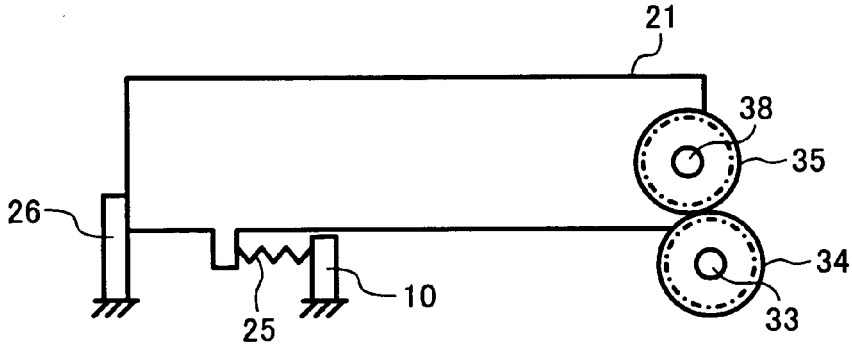
FIG. 5A is a schematic view illustrating a state of the developing device in which the developing cartridge is separated from the image bearing member (such as a photoreceptor)
Figure 5B:
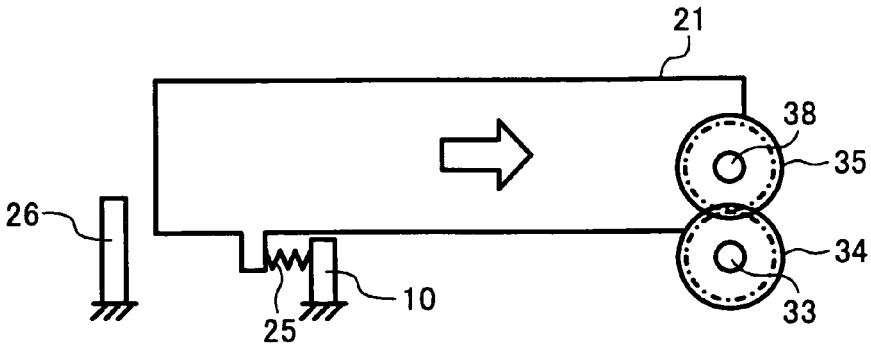
FIG. 5B is a schematic view illustrating another state of the developing device in which the developing cartridge is separated from the image bearing member is moved so as to be close to (or contacted with) the image bearing member (i.e., the photoreceptor)

As illustrated in FIGS. 5A and 5B, a compression spring 25 is provided between the developing cartridge 21 and a housing 10 of the main body of the printer 1 to apply an elastic force to the developing cartridge 21 in a direction such that the developing cartridge 21 is separated from the photoreceptor 11. When the developing cartridge 21 is not used, the cartridge 21 has a receding state where the developing cartridge 21 contacts a stopper 26.

FIG. 3 is a front view of the contact/separate mechanism 3. The contact/separate mechanism 3 is provided in the vicinity of the developing cartridge 21, and includes two driven gears 35 which are mounted on a rotation shaft 38 on which the developing roller 22 is mounted. In addition, the mechanism 3 includes driving gears 34 which are mounted on a driving shaft 33 and engaged with the respective driven gears 35. The driving shaft 33 is rotatably mounted on the housing 10 of the main body of the printer via bearings 10D. In addition, a clutch 32D is provided on an end of the driving shaft 33. The driving force of a driving motor 31 which is provided in the main body of the printer is transmitted to or prevented from being transmitted to the driving shaft 33 via three gears of a driving mechanism mentioned later.

When the rotation driving force of the driving motor 31 is transmitted to the driving shaft 33 and thereby the driving shaft 33 is rotated, the driving gears 34 mounted on the driving shaft 33 are rotated. The rotation driving force is also transmitted to the driven gears 35 which are engaged with the driving gears 34, and thereby the developing roller 22 can be rotated and the developing cartridge 21 can be moved toward the photoreceptor 11.

Figure 6:
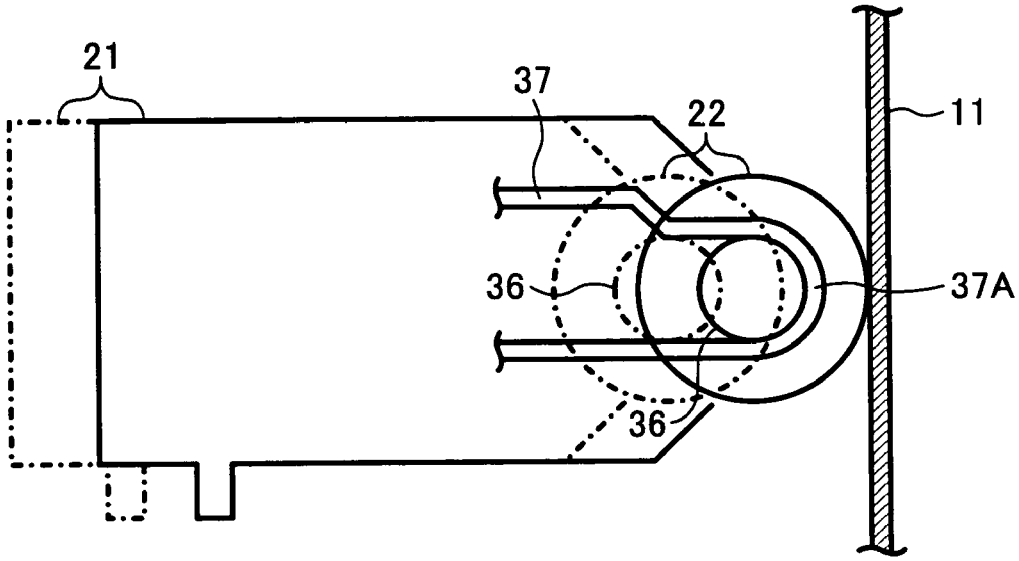
FIG. 6 is a schematic view illustrating a guide member for guiding the developing roller so as to contact (or closely approach) an image bearing member.

On both ends of the rotating shaft 38, caps 36 are provided. In addition, guide members 37 are provided on the housing 10 of the main body to guide the caps 36 to move back and forth. As illustrated in FIG. 6, the guide member 37 has a form such that an end portion 37A thereof on the side of the photoreceptor 11 has a relatively narrow diameter compared to that of the center portion. When the cap 36 contacts the end portion 37A, the developing cartridge 21 is stopped so as to be prevented from approaching the photoreceptor 11 excessively closely, i.e., such that a predetermined gap is formed between the developing cartridge 21 and the photoreceptor 11. Thus, the developing cartridge 21 and the developing roller 22 take the developing position.

When the developing cartridge 21 has the developing position as illustrated in FIG. 5B and the clutch 32D is engaged, a tangential driving force is generated due to the load torque of the developing roller 22 itself and thereby the developing cartridge 21 is moved toward the photoreceptor 11 while opposing the elastic force of the compression spring 23. In addition, the developing roller 22 is rotated in a forward direction and thereby the developing operation is performed. When it is desired to remove the toner particles and foreign materials staying at the nip between the developing roller 22 and the regulation roller 24, the motor 31 is reversely rotated and the clutch 32D is engaged, resulting in reverse rotation of the developing roller 22. In this case, a tangential driving force is applied to the developing cartridge 21 in such a direction as to separate the developing cartridge 21 from the photoreceptor 11. Thus, it is not necessary to provide a member configured to prevent the developing cartridge 21 from moving toward the photoreceptor 11.

Then the regulation roller 24 will be explained.

FIG. 4 illustrates a state where the developing roller 22 is reversely rotated to remove the toner particles and foreign materials staying at the nip between the developing roller 22 and the regulation roller 24. The regulation roller 24 is pressed toward the developing roller 22 by a spring or the like so that the regulation roller 24 is rotated in the counterclockwise direction while driven by the developing roller 22.

Figure 7:
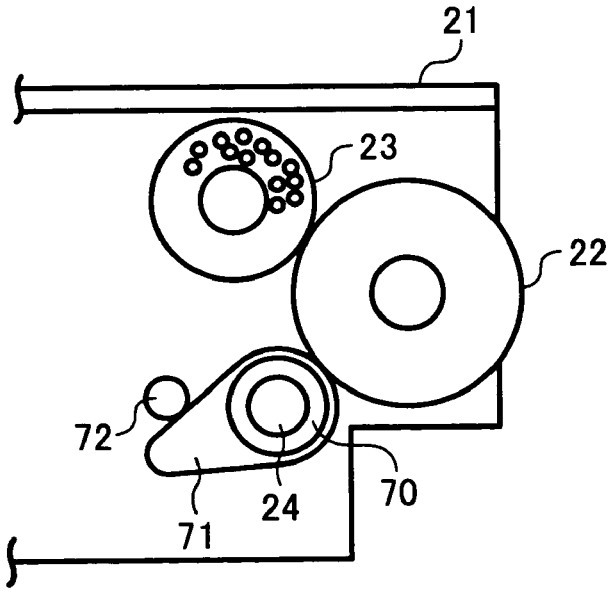
FIG. 7 is a schematic view illustrating a mechanism for regulating the rotation direction of the regulation roller for use in the image forming apparatus of the present invention.

FIG. 7 illustrates another embodiment of the developer thickness controlling member in which when the developing roller 22 is forwardly (i.e., counterclockwise) rotated, the rotation of the regulation roller 24 is regulated. In the developer thickness controlling member, a one-way clutch 70 is provided on an end of the regulation roller 24. A housing 71 having a projection is pressed into the one-way clutch 70. In addition, a stopper 72 is provided on a portion of the developing cartridge 21 so as to be located on a rotation path of the housing 71. When the developing roller 22 is forwardly (i.e., counterclockwise) rotated, the regulation roller 24 is rotated while driven by the developing roller 22. In this case, the one-way clutch 70 is engaged, and thereby the housing 71 is rotated together with the one-way clutch 70 in the counterclockwise direction. When the projection of the housing 71 contacts the stopper 72, the rotation of the regulation roller 24 is stopped while the one-way clutch is locked. In this case, the one-way clutch 70 is used for preventing the regulation roller 24 from rotating together with the developing roller 22 when the developing roller is forwardly rotated, but other devices can also be used instead of the one-way clutch 70.

Figure 8:
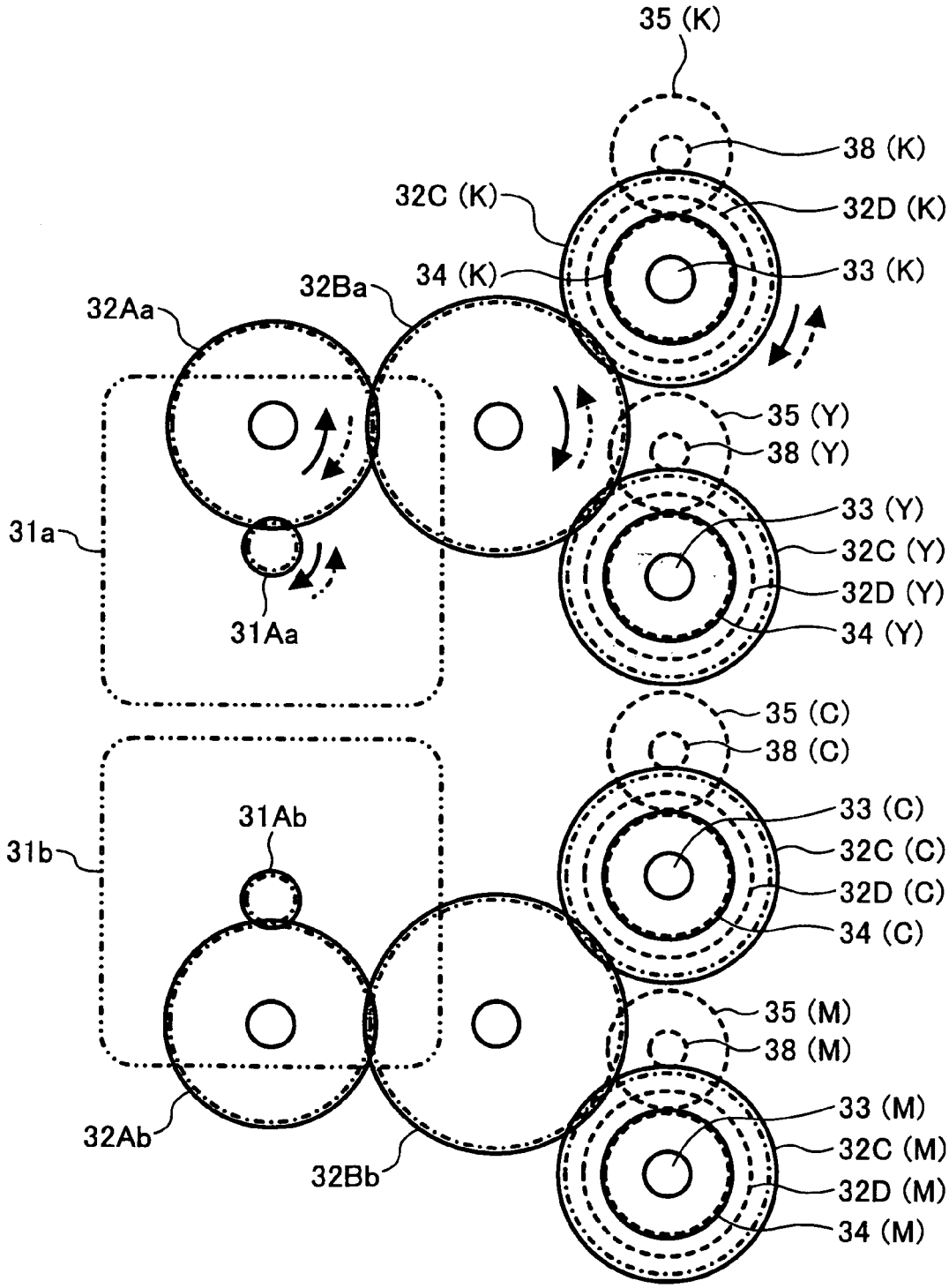
FIG. 8 is a schematic view illustrating an embodiment of the driving device for use in the image forming apparatus of the present invention.

The driving mechanism for use in this embodiment is illustrated in FIG. 8. The driving mechanism includes a driving motor 31*a* configured to drive the K and Y developing cartridges which are located in upper positions; and another driving motor 31*b* configured to drive the C and M developing cartridges which are located in lower positions. The motors 31*a* and 31*b* are provided on the housing of the main body while arranged in a line in a vertical direction.

A first gear 32Aa and a second gear 32Ba which are rotated by the driving force of the driving motor 31*a* are provided. The second gear 32Ba is engaged with a third gear 32C(K) of the K developing cartridge 21K, which is mounted on a clutch 32D(K) thereof. In addition, the second gear 32Ba is also engaged with a third gear 32C(Y) of the Y developing cartridge 21Y, which is mounted on a clutch 32D(Y) thereof. The K developing cartridge and the Y developing cartridge are arranged in a line in a vertical direction.

The clutch 32D(K) and a driving gear 34(K), which drives the K developing roller and the K developing cartridge, are coaxially mounted on a driving shaft 33(K). In addition, the driving gear 34(K) is engaged with the driven gear 35 mounted on the rotation shaft 38 of the developing roller 22, as illustrated in FIG. 3. Similarly, the clutch 32D(Y) and the driving gear 34(Y) are coaxially mounted on a driving shaft 33(Y).

Similarly, the driving motor 31*b*, which is located at a position lower than that of the driving motor 31*a*, includes a first gear 32Ab and a second gear 32Bb. The second gear 32Bb is engaged with a third gear 32C(C) of the C developing cartridge 21C, which is mounted on a clutch 32D(C) thereof. In addition, the second gear 32Bb is also engaged with a third gear 32C(M) of the M developing cartridge 21M, which is mounted on a clutch 32D(M) thereof. In addition, similarly to the case mentioned above, the clutches 32D(C) and 32D(M) are mounted on respective driving shafts 33(C) and 33(M) on which the driving gears 34(C) and 34(M) are mounted, respectively.

Then the developing operation of the developing unit for use in the image forming apparatus of the present invention will be explained referring to FIGS. 9A–9F and 10B.

Figure 9A:
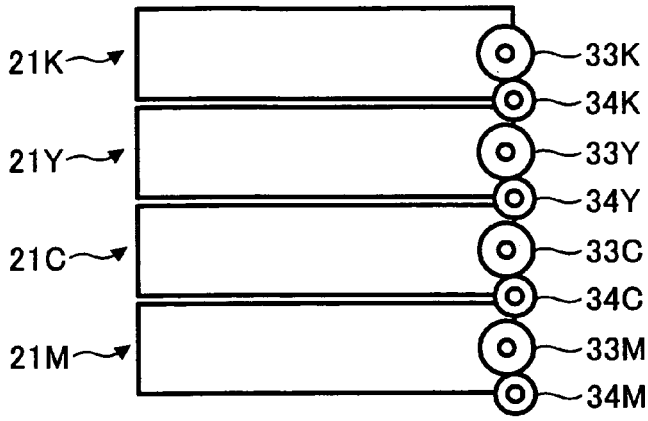
FIGS. 9A to 9F illustrate how the developing cartridges and developing rollers are approached to (or contacted with) the image bearing member and separated therefrom.
Figure 9B:
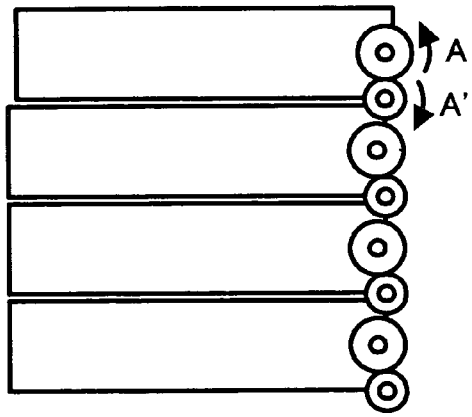

When the developing operation is started, the driving motor 31*a* is forwardly rotated at a predetermined rotation speed. The rotation force of the gears are transmitted to the driving shaft 33K while the clutch 32D(K) is engaged by a driving mechanism (not shown in FIG. 9). When the clutch 32D(K) is engaged, the K developing cartridge 21K is moved toward the photoreceptor 11 while opposing the elastic force of the compression spring 25 (illustrated in FIG. 5B), and the K developing roller is rotated in a forward direction as illustrated in FIG. 9B. Thus, the K developing operation is performed.

When the black color (K) developing operation is completed, the clutch 32D(K) is disengaged and the motor 31*a* is stopped once. When the clutch 32D(K) is disengaged, the black color developing cartridge 21K is retreated due to the elastic force of the compression spring 25, and is stopped while the back of the developing cartridge 21K is contacted with the stopper 24 which is illustrated in FIG. 5A and which is mounted on the housing of the main body.

Figure 9C:
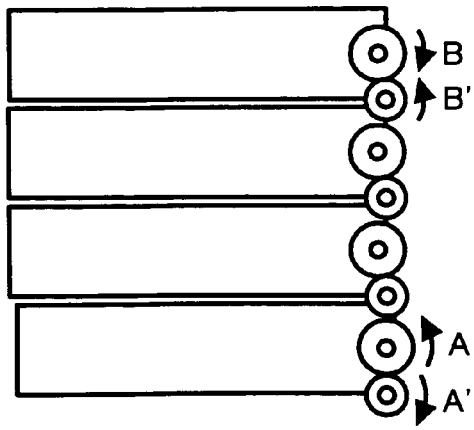

Then the driving motor 31*a* optionally rotates reversely at a predetermined speed slower than that in the forward rotation. At the same time, the other driving motor 31*b* rotates in the forward rotation direction at a predetermined rotation speed. Then the clutch 32D(K) and the clutch 32D(M) are engaged to transmit the driving forces to the respective driving shafts. The developing roller connected with the clutch 32D(K) is reversely rotated to remove the toner particles and foreign materials staying at the nip between the (K) developing roller and the (K) regulation roller. On the other hand, the (M) developing device 21M to which the driving force is transmitted by the clutch 32D(M) is moved toward the photoreceptor 11 and the (M) developing roller is rotated in the forward direction. Thus, the magenta color developing operation is performed as illustrated in FIG. 9C.

Figure 9D:
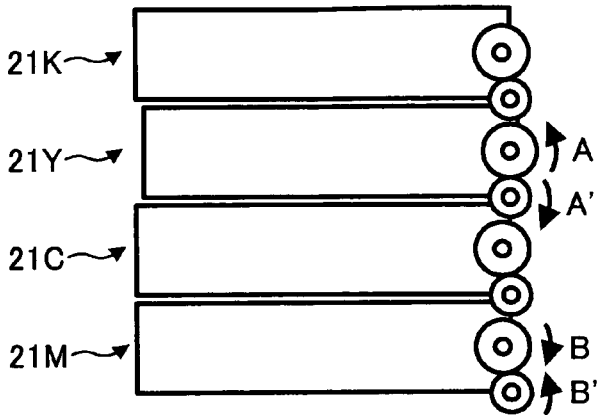
Figure 9E:
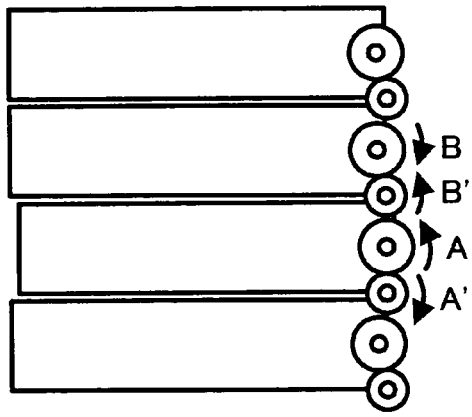
Figure 9F:
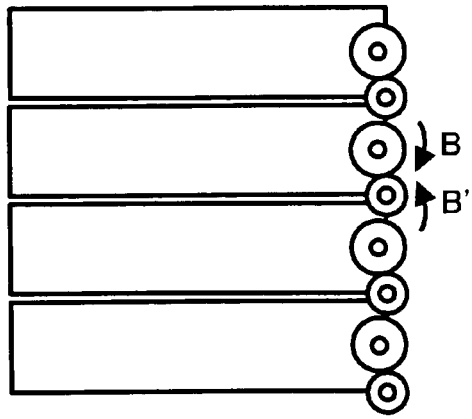

Similarly to the operations mentioned above, after the magenta color developing operation is completed, the yellow color developing operation is performed while the toner particles and foreign materials staying at the nip between the (M) developing roller and the (M) regulation roller are removed as illustrated in FIG. 9D. In addition, after the yellow color developing operation is completed, the cyan color developing operation is performed while the toner particles and foreign materials staying at the nip between the (Y) developing roller and the (Y) regulation roller are removed as illustrated in FIG. 9E. When no developing operation is performed, the toner particles and foreign materials staying at the nip between the (C) developing roller and the (C) regulation roller are removed as illustrated in FIG. 9F. When this image forming cycle is continuously performed, the toner particles and foreign materials staying at the nip between the (C) developing roller and the (C) regulation roller are removed while the next black color developing operation is performed.

In this embodiment, the latent image forming and developing operations are performed in the order of black (K), magenta (M), yellow (Y) and cyan (C) colors, but the order is not limited thereto. In addition, the foreign material removing operations (i.e., the reverse rotation operations of the developing rollers) are not limited to the order mentioned above.

Figure 1:
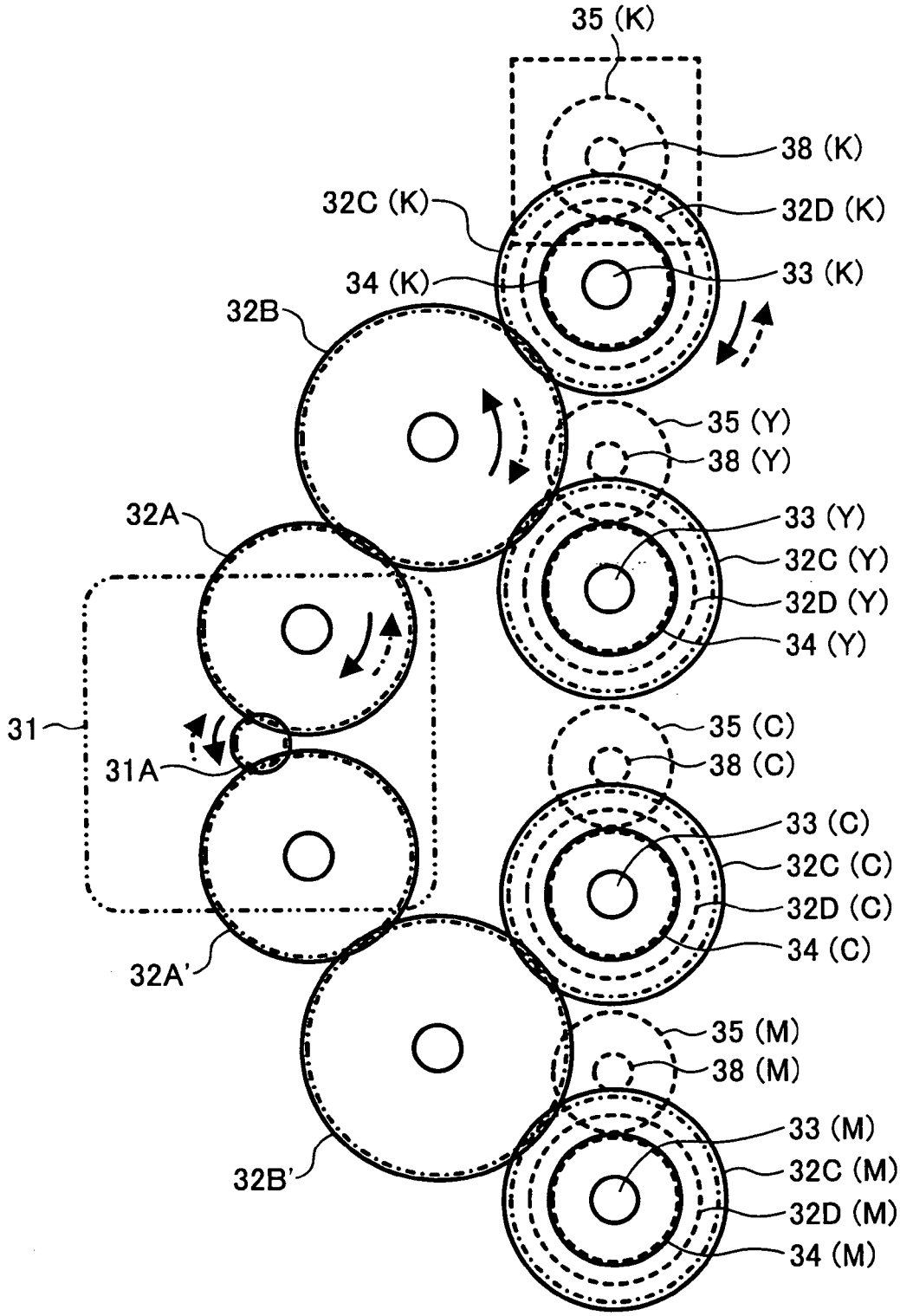
FIG. 1 BACKGROUND ART
FIG. 1 is a schematic view illustrating a background driving device for use in an image forming apparatus.
Figure 10A:
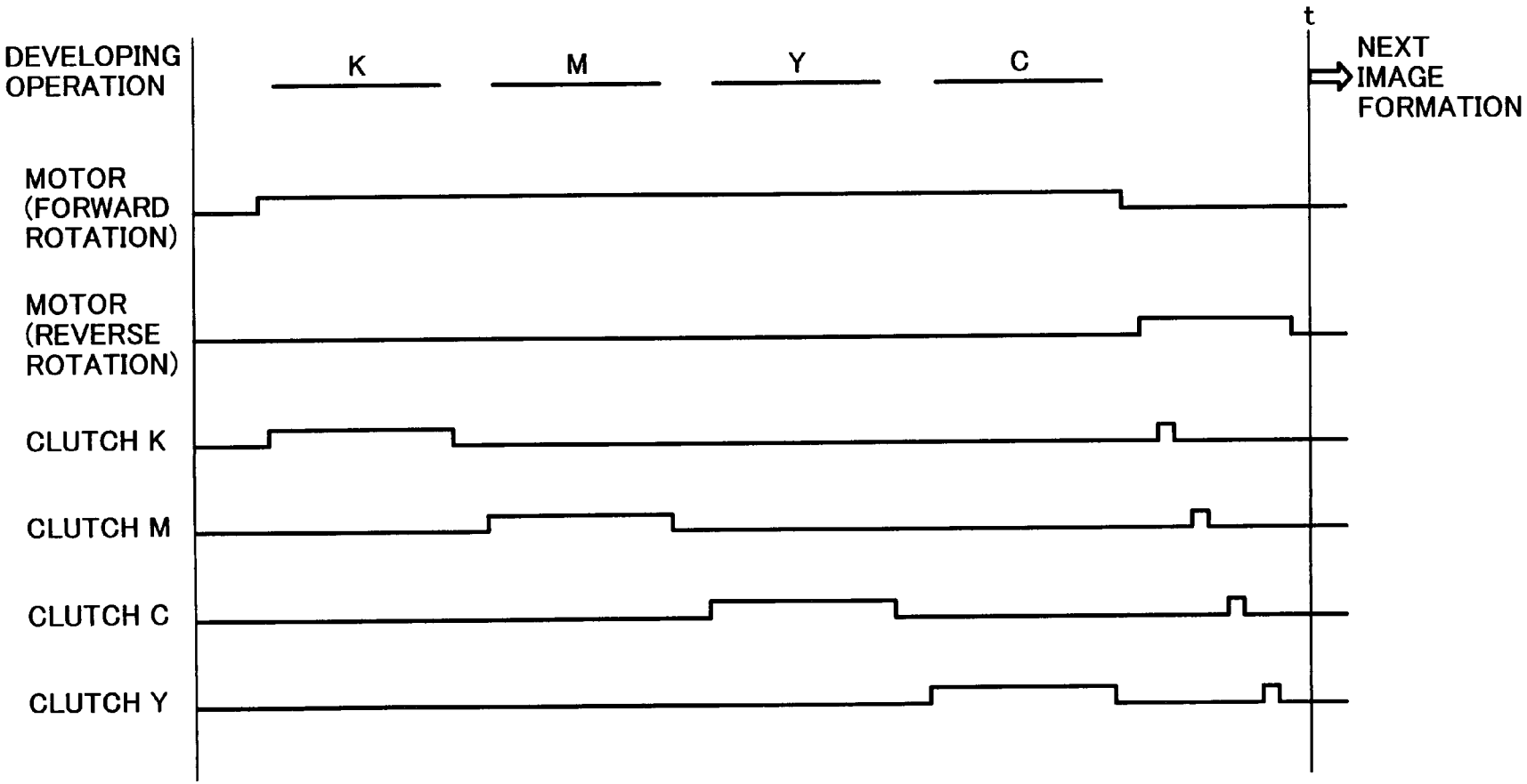
FIG. 10A BACKGROUND ART
FIG. 10A is a timing chart illustrating the developing operation and the foreign material removing operation of a background developing device.
Figure 10B:
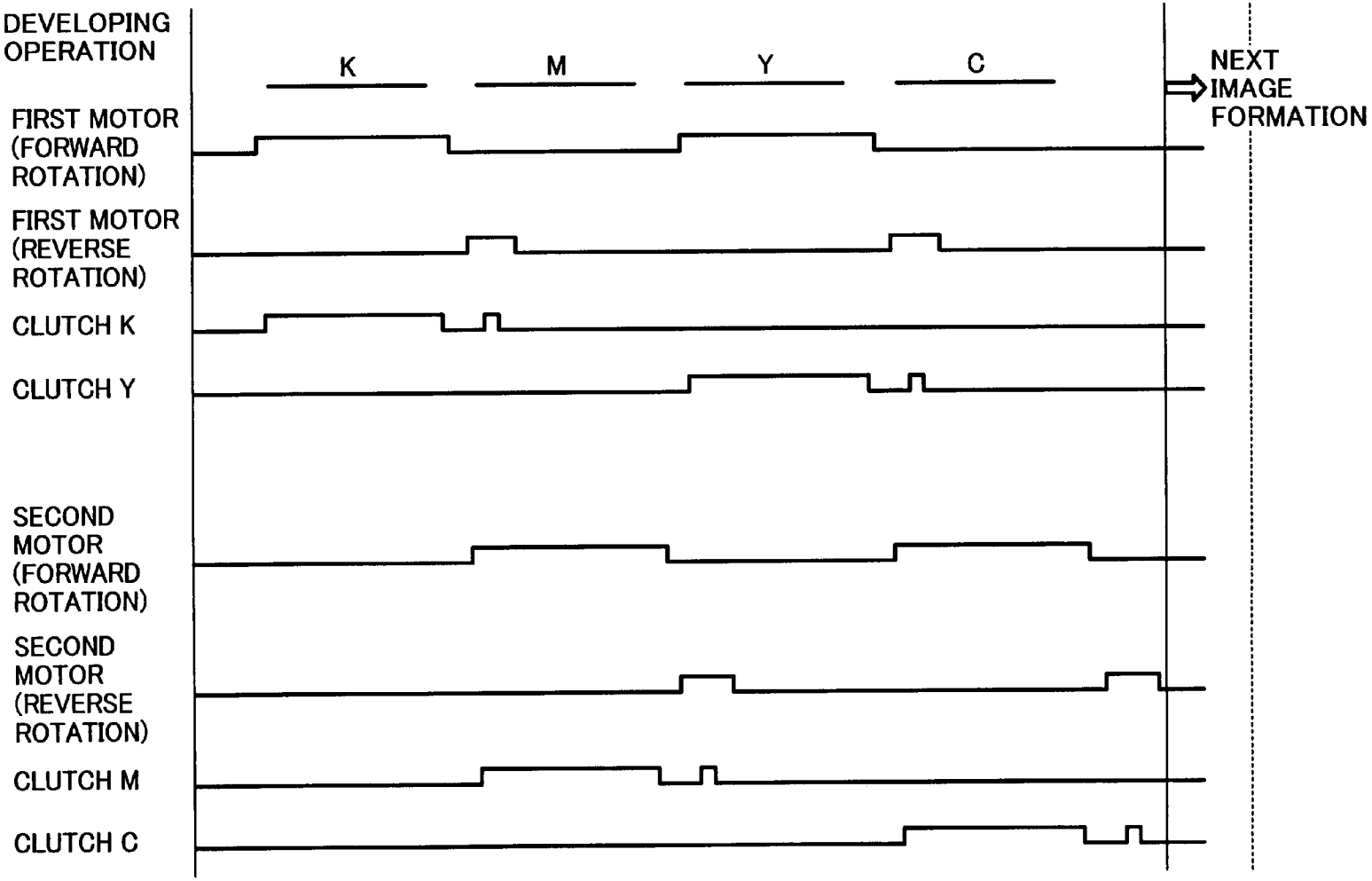
FIG. 10B is a timing chart illustrating the developing operation and the foreign material removing operation of the developing device for use in the image forming apparatus of the present invention.

FIG. 10A is a timing chart illustrating how the motor and clutches of the background developing device, which is illustrated in FIG. 1, operate. FIG. 10B is a timing chart illustrating how the motors and clutches of the developing device for use in the image forming apparatus, which is illustrated in FIG. 8, operate. As can be understood from FIGS. 10A and 10B, the developing device of the image forming apparatus of the present invention can perform the color image forming operation in a shorter time (t') than that (t) of the background developing device. Specifically, the developing operation can be decreased by 1 to 5 seconds per one developing cycle. The shortened time changes from 1 to 5 seconds depending on the period in which the developing rollers are reversely rotated. In addition, a motor having such a power as to be able to drive one developing cartridge can be used for the motor 31*a* or 31*b*. Therefore, a small and low-cost motor can be used therefor, and thereby the developing device can be miniaturized and made at a low cost.

Figure 11A:
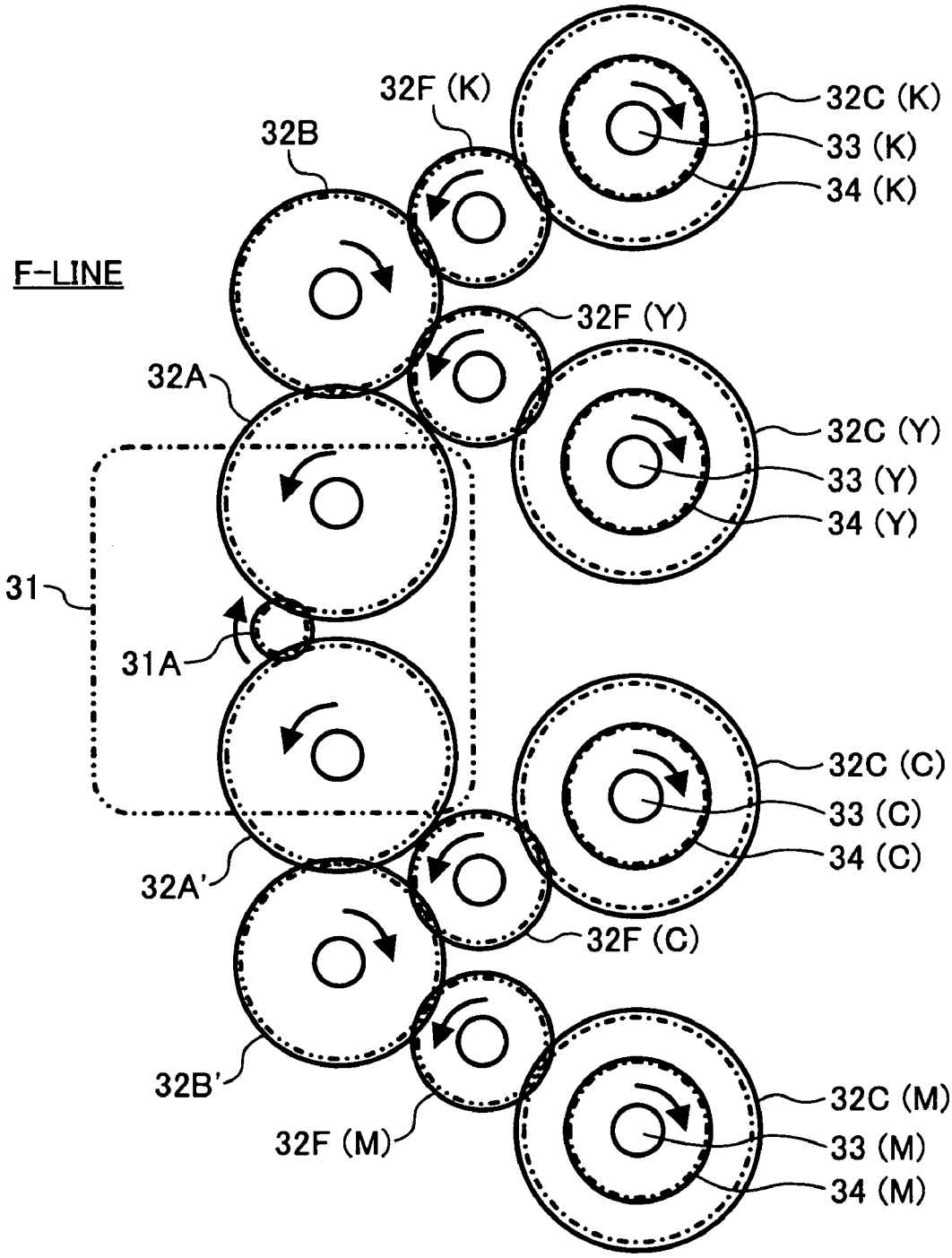
FIG. 11A and FIG. 11B are schematic views illustrating other embodiments of the developing device of the image forming apparatus of the present invention.
Figure 11B:
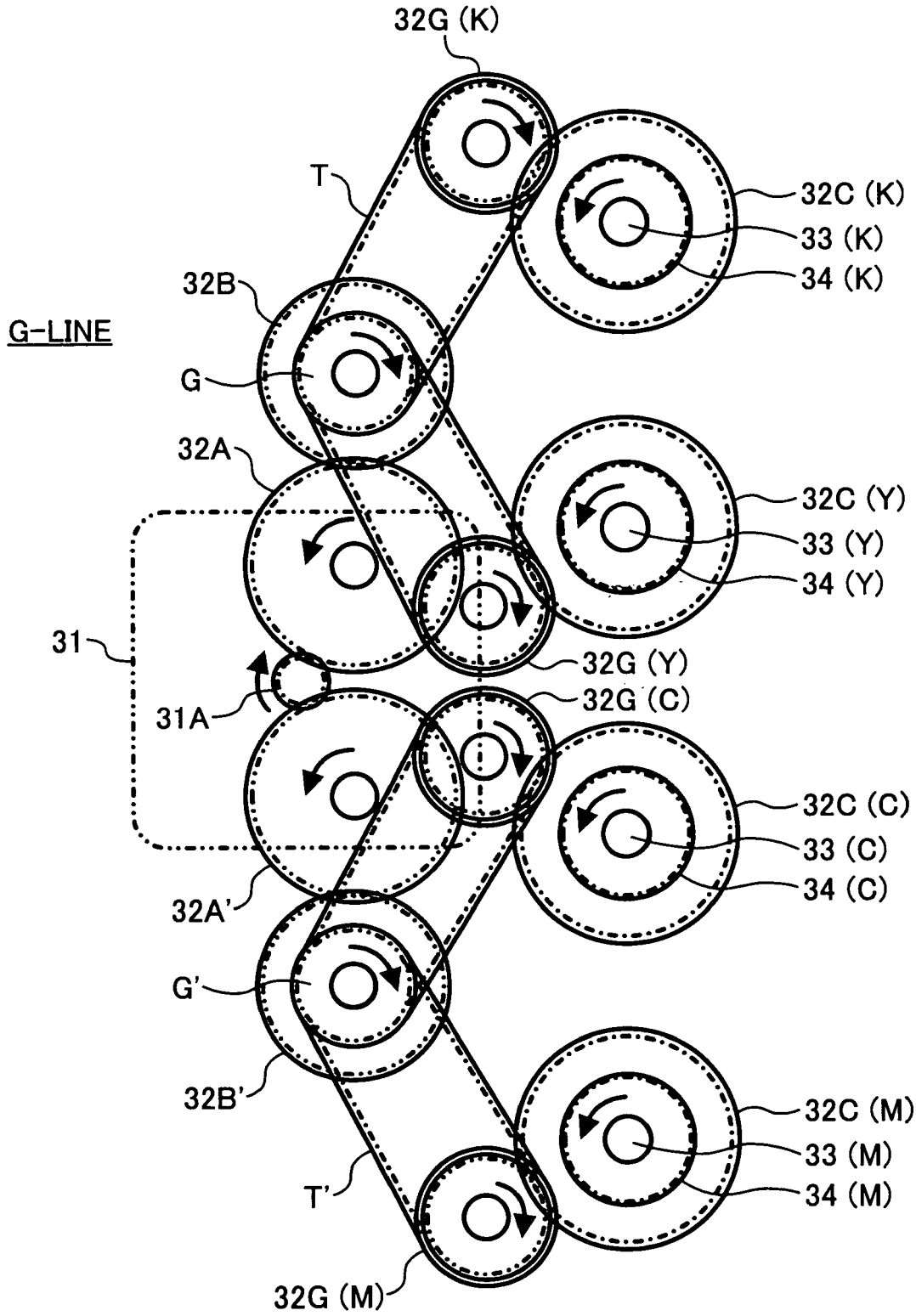

FIGS. 11A and 11B illustrate another embodiment of the driving system for use in the developing device of the image forming apparatus of the present invention.

FIG. 11A illustrates forward rotation driving system (F-line), which drives the developing rollers to rotate in a forward direction. FIG. 11B illustrates reverse rotation driving system (G-line), which drives the developing rollers to rotate in a revere direction. The F-line and the G-line are arranged so as to be parallel to each other in such a direction that the driving shaft 33 extends. A driving motor 31, two first gears 32A and 32B, and driving gears 34(K), 34(Y), 34(C) and 34(M) are shared by the F-line and the G-line.

In the driving system of this embodiment, a motor gear 31A of the driving motor 31 is engaged with an upper first gear 32A and a lower first gear 32A'. The upper first gear 32A is engaged with an upper second gear 32B which is located over the upper first gear 32A, and the lower first gear 32A' is engaged with a lower first gear 32B' which is located under the lower first gear 32A'.

The driving force of the upper second gear 32B is transmitted to a third gear 32C(K) mounted on a driving shaft 33(K) for use in developing black color images and to another third gear 32C(Y) mounted on a driving shaft 33(Y) for use in developing yellow color images, via respective clutches 32F(K) and 32F(Y). Similarly, the driving force of the lower second gear 32B' is transmitted to a third gear 32C(C) mounted on a driving shaft 33(C) for use in developing cyan color images and to another third gear 32C(M) mounted on a driving shaft 33(M) for use in developing magenta color images, via respective clutches 32F(C) and 32F(M).

In addition, driving gears 34(K), 34(Y), 34(C) and 34(M) are mounted on the respective driving shafts 33(K), 33(Y), 33(C) and 33(M). The driving gears 34(K), 34(Y), 34(C) and 34(M) are engaged with respective driven gears 35 which are mounted on the respective driving shafts 38 of the respective developing rollers 22 and which are illustrated in FIG. 3.

The forward rotation driving system (F-line) includes the clutches 32F(K) and 32F(Y), to which rotation force is transmitted by the upper second gear 32B, and the clutches 32F(C) and 32F(M), to which rotation force is transmitted by the lower second gear 32B'.

The clutch 32F(K) used for black color image formation is equipped with a gear, which is engaged with both the upper second gear 32B and the third gear 32C(K) mounted on the driving shaft 33(K). Thus, the driving force of the motor 31 is transmitted to the driving gear 34(K), and thereby the driving gear 34(K) is rotated in the clockwise direction (i.e., in the forward direction). Similarly to this driving system for black color image formation, driving force is transmitted in the driving systems for cyan, magenta and yellow color image formation, and the respective driving gears are rotated in the forward direction.

The reverse rotation driving system (G-line) includes clutches 32G(K) and 32G(Y), to which a rotational force is transmitted by the upper second gear 32B, and clutches 32G(C) and 32G(M), to which rotation force is transmitted by the lower second gear 32B'. In order to reversely rotate the driving shafts 33(K), 33(Y), 33(C) and 33(M), rollers G and G' having respective timing belts T and T' are provided on a location inside or outside of the respective upper and lower second gears 32B and 32B'.

In addition, each of the clutches 32G(K), 32G(Y), 32G(C) and 32G(M) has a portion bearing the timing belts T and T'. Further, a gear is provided on a location inside or outside of the portion bearing the timing belt T or T'. Since the gear is engaged with the third gear 32C, the driving force is transmitted to the driving gear 34. In this case, the rotation direction of the clutch 32G is the same as that (i.e., the clockwise direction) of the second gear 32B. Therefore, the driving gear 34 is reversely rotated.

In the developing device having such a constitution as illustrated in FIGS. 11A and 11B, it is possible to perform a black color image forming operation and a foreign material removing operation for the (Y) developing device at the same time by engaging the clutch 32F(K) and the clutch 32G(Y). When the driving torque of the developing cartridge used is small, the width of the gears and the timing belts can be decreased, and in addition the motor and clutches can be miniaturized, resulting in cost reduction.

The first-mentioned driving system for use in the image forming apparatus of the present invention has two different lines, one of which includes the upper developing cartridges 21K and 21Y and the upper developing rollers 22 for black and yellow color image formation and the other of which includes the lower developing cartridges 21C and 21M and the lower developing rollers 22 for cyan and magenta color image formation. Therefore, the lower developing rollers can be rotated in a direction opposite to that of the upper developing rollers. Therefore, one of the developing rollers which have completed its developing operation can be reversely rotated before the next color developing operation starts or during the next color developing operation is performed. Thus, it is possible to perform the foreign material removing operation while an image forming operation for another color image is performed. As a result, images having good image qualities can be reproduced without decreasing the image forming speed even when images are continuously produced.

The second-mentioned driving system has both the forward rotation driving system (F-line) in which the developing roller are forwardly rotated and the reverse rotation driving system (G-line) in which the developing rollers are reversely rotated. Therefore, when one of the developing rollers is rotated in the forward direction by the forward rotation driving system (F-line), the other developing rollers can be reversely rotated by the reverse rotation driving system (G-line). Therefore, one of the developing rollers which have completed its developing operation can be reversely rotated to perform the foreign material removing operation when the other color developing operation is performed. As a result, images having good image qualities can be reproduced without decreasing the image forming speed even when images are continuously produced.

The contact/separate mechanism for use in the image forming apparatus of the present invention not only moves the developing device toward the image bearing member (i.e., the photoreceptor) utilizing the tangential driving force of gears such that the developing cartridge has a position close to the photoreceptor but also rotates the developing roller. Namely, both the movement of the developing cartridge and the rotation of the developing roller can be performed by only one mechanism, resulting in simplification of the developing device.

In addition, the regulation roller for use in the image forming apparatus of the present invention is rotated while driven by the developing roller when the developing roller is reversely rotated whereas the regulation roller is stopped when the developing roller is forwardly rotated. Therefore, it is possible to securely remove the toner particles and foreign materials staying at the nip between the developing roller 22 and the regulation roller 24. In addition, the portion of the regulation roller which is pressed by the developing roller is not limited because the regulation roller is sometimes rotated while driven by the developing roller. Therefore, the regulation roller is hardly abraded, and thereby good images can be stably produced for a long period of time.

Effect of the Invention

In the image forming apparatus of the present invention, a developing roller can be reversely rotated to remove toner particles and foreign materials staying at the nip between the developer bearing member (such as developing rollers) and a developer thickness controlling member (such as regulation rollers) while an image forming operation for another color image is performed. Therefore, images having good image qualities can be reproduced without decreasing the image forming speed even when images are continuously produced.

This document claims priority and contains subject matter related to Japanese Patent Application No. 2003-146881, filed on May 23, 2003, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member configured to bear latent images;

a developing unit comprising:

a plurality of developing devices configured to develop the latent images with respective developers to form visual images on the image bearing member, wherein each of the plurality of developing devices includes:

a developer bearing member configured to bear the corresponding developer to develop the corresponding latent image; and a developer thickness controlling member which contacts the corresponding developer bearing member to control the thickness of a layer of the corresponding developer on the corresponding developer bearing member wherein when one of the plurality of developing devices performs a developing operation, the developer bearing member of said one of the plurality of developing devices is forwardly rotated and the developer bearing members of other developing devices of the plurality of developing devices, which do not perform a developing operation, are reversely rotated at a predetermined speed slower than the developer bearing member of said one of the plurality of developing devices forwardly rotated.

2. The image forming apparatus according to claim 1, wherein the developer thickness controlling members have a roller-form, wherein the developer thickness controlling members are stopped when the respective developer bearing members rotate to develop the latent images, and when the respective developer bearing members are reversely rotated, the developer thickness controlling members is rotated while driven by the respective developer bearing members.

3. The image forming apparatus according to claim 1, wherein the developing unit further comprises:

driving gears mounted on both ends of respective support shafts of the developer bearing members, wherein the developer bearing members are supported by the respective support shafts; and drive force transmitting gears which are engaged with the respective driving gears, wherein when the driving gears are rotated to rotate the respective developer bearing members, the corresponding developing device is moved to a position close to the image bearing member due to the tangential driving force of the driving gears.

4. An image forming apparatus, comprising:

image bearing means configured to bear latent images;

developing means comprising a plurality of developing means configured to develop the latent images with respective developers to form visual images on the image bearing means, wherein each of the plurality of developing means includes developer bearing means configured to bear the corresponding developer to develop the corresponding latent image; and developer thickness controlling means which contacts the corresponding developer bearing means to control the thickness of a layer of the corresponding developer on the corresponding developer bearing means wherein when one of the plurality of developing means performs a developing operation, the developer bearing means of said one of the plurality of developing means is forwardly rotated and the developer bearing means of the other developing means, which do not perform a developing operation, are reversely rotated at a predetermined speed slower than the developer bearing member of said one of the plurality of developing devices forwardly rotated.

5. An image forming method, which comprises:

providing an image bearing member configured to bear latent images;

providing a developing unit which utilizes a plurality of developing devices configured to develop the latent images with respective developers to form visual images on the image bearing member, wherein the utilization of each of the plurality of developing devices includes configuring a developer bearing member to bear the corresponding developer to develop the corresponding latent image; and contacting a developer thickness controlling member with the corresponding developer bearing member to control the thickness of a layer of the corresponding developer on the corresponding developer bearing member, and performing a developing operation with one of the plurality of developing devices while forwardly rotating the developer bearing member of the one of the plurality of developing devices and reversely rotating the developer bearing member of the other of the developing devices, which do not perform a developing operation at a predetermined speed slower than the developer bearing member of said one of the plurality of developing devices forwardly rotated.

* * * * *